United States Patent [19]

Lassiter et al.

[11] Patent Number: 4,739,522

[45] Date of Patent: Apr. 26, 1988

[54] COLD WEATHER GARMENT WITH IMPROVED BUOYANCY

[75] Inventors: B. Dean Lassiter; George B. Jordan, both of Greensboro, N.C.

[73] Assignee: Burlington Industries, Inc., Greensboro, N.C.

[21] Appl. No.: 15,981

[22] Filed: Feb. 18, 1987

[51] Int. Cl.[4] ..... A41D 1/02; A41D 1/06

[52] U.S. Cl. ..... 2/69; 2/93; 2/97; 2/81; 2/227; 2/79; 2/243 R; 2/272

[58] Field of Search ..... 2/69, 79, 81, 82, 93, 2/102, 97, 115, 227, 243 R, 272

[56] References Cited

U.S. PATENT DOCUMENTS

| | | | |
|---|---|---|---|
| 2,897,508 | 8/1959 | Bashore et al. . | |
| 3,369,262 | 2/1968 | Judd . | |
| 4,411,033 | 10/1985 | Morgan . | |
| 4,495,661 | 1/1985 | Kamat | 2/97 |
| 4,569,874 | 2/1986 | Kuznetz | 2/69 |

FOREIGN PATENT DOCUMENTS

| | | | |
|---|---|---|---|
| 1085235 | 9/1980 | Canada . | |
| 1225276 | 3/1971 | United Kingdom | 2/272 |
| 2041300 | 9/1980 | United Kingdom . | |
| 2122548 | 1/1984 | United Kingdom . | |

OTHER PUBLICATIONS

"Shipboard Evaluation of Experimental Model . . . "; RENS 14-02-001-00-1; Zemme et al.; U.S. Naval Supply Research and Development Facility; Apr., 1966.

"Physiological Evaluation of A1 . . . "; Avellini; Navy Clothing and Textile Research Facility; Report No. 150; Aug., 1983.

NCTFR Mission Statement, Discussion of General Facilities; Sep., 1981.

*Primary Examiner*—H. Hampton Hunter

*Attorney, Agent, or Firm*—Nixon & Vanderhye

[57] ABSTRACT

A cold weather buoyant garment has inner and outer layers with an intermediate layer therebetween. The intermediate layer is formed of a major portion of open cell foam material, such as polyurethane, with a minor portion of a closed cell material, such as polystyrene beads, uniformly dispersed in the open cell material. This composite intermediate layer exhibits good vapor transmission characteristics while simultaneously providing buoyancy characteristics sufficient to assist an individual immersed in cold water and wearing the garment to remain afloat.

20 Claims, 1 Drawing Sheet

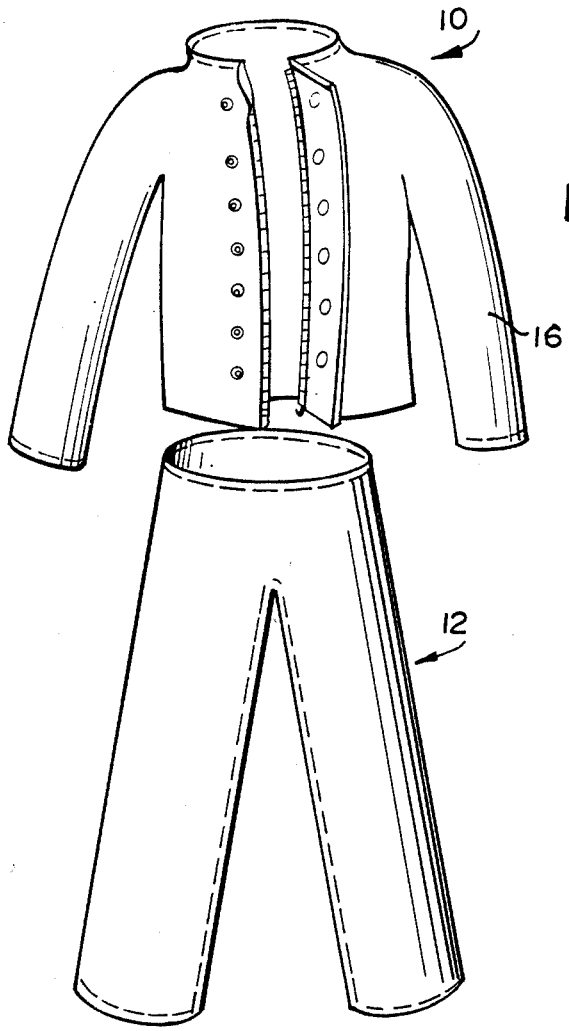
FIG. 1
FIG. 3
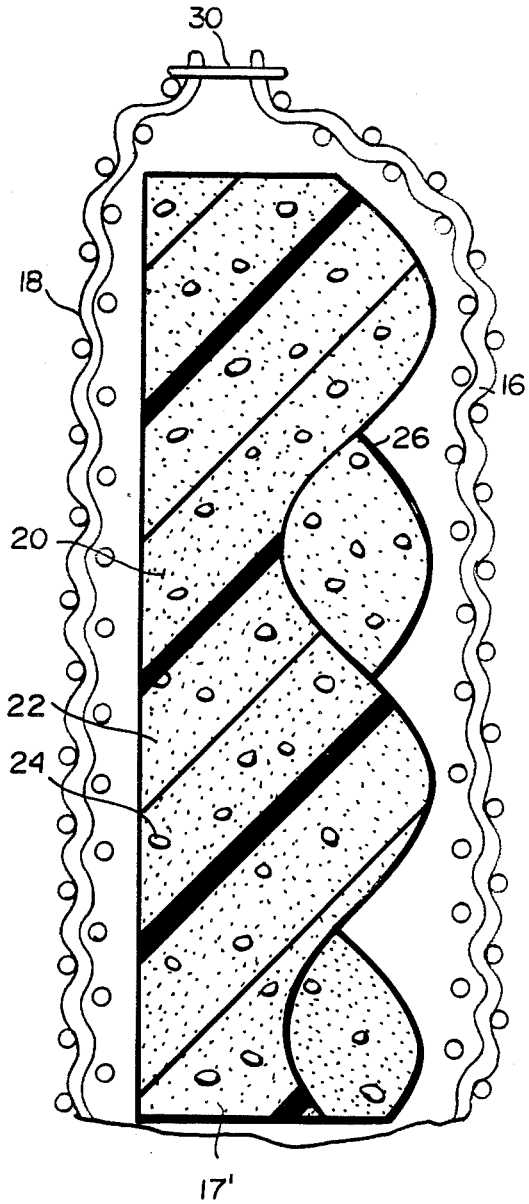
FIG. 2
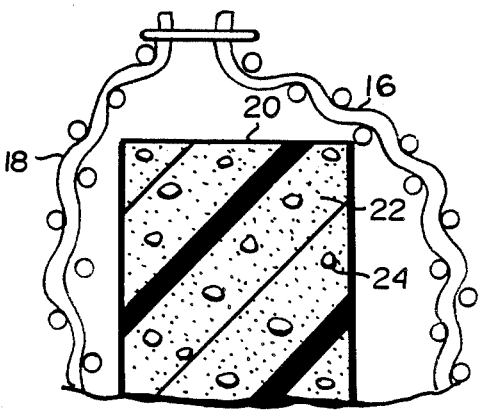

COLD WEATHER GARMENT WITH IMPROVED BUOYANCY

BACKGROUND OF THE INVENTION

Survival in adverse cold weather conditions depends substantially on the protection afforded by the garments worn by the individual. Those garments should exhibit good thermal comfort characteristics under various types of exposure conditions. A known cold weather garment system provides upper and lower body garments which afford substantial cold weather protection for the torso excluding the feet, hands and head. Such system, known as the Phillips System, includes an outer fabric of nylon or the like, an inner lining fabric of loosely-knit or woven construction, and an intermediate open-cell foam disposed between the inner and outer fabrics and connected to the fabrics by stitching along the edges of the garment and elsewhere, if required.

A cold weather garment, which is an improvement on the Phillips System, is described and illustrated in U.S. patent application Ser. No. 879,053, filed June 26, 1986, of common assignee herewith. According to that invention, the face of the intermediate foam is convoluted. In that manner, increased flexibility and moisture vapor transmission through the garment and a reduction in the amount of material and weight of the garment are achieved. Moreover, all of that is accomplished without any decrease in the warmth retention properties of the garment. However, the garments constructed in accordance with the Phillips System and those of the above-referenced patent application are concerned with thermal comfort characteristics and not the additional cold weather exposure situation where an individual may become immersed in cold water.

SUMMARY OF THE PRESENT INVENTION

According to the present invention, there is provided a cold weather garment which exhibits good thermal characteristics when exposed to cold weather ambient air conditions as well as good thermal and buoyancy characteristics when the individual wearing the garment is immersed in cold water. By providing a unique construction of the intermediate insulating foam for disposition between inner and outer garment layers, substantial thermal and buoyancy characteristics are obtained. Particularly, the intermediate insulating foam is formed of a composite comprising a major portion of an open cell foam with a minor portion of a closed cell material interspersed therein. In this manner, moisture vapor permeability or transmission is afforded by the open cell foam structure while buoyancy characteristics are provided by the closed cell material. Preferably, the closed cell material takes the form of a plurality of polystyrene pellets of substantially uniform size interspersed in an open cell polyurethane foam. Thus, the composite intermediate foam material provides substantial thermal protection, as well as buoyancy to the wearer when floating in water. A further advantage of the cold weather garment according to the present invention resides in the ability to squeeze or press the water from the garment, allowing the individual's body heat to subsequently dry the garment.

It will be appreciated that the addition of closed cell foam material to the intermediate foam material of the garment has a tendency to increase the stiffness of the garment and decrease the moisture vapor permeability. Those drawbacks, according to the present invention, can be overcome by convoluting the intermediate insulating foam, for example, in the manner set forth in the above-referenced co-pending patent application, or by crushing the composite insulating foam. By crushing the intermediate layer, flexibility is increased, while at the same time a reduction in thickness of the layer and hence the garment is accomplished, together with increased air permeability. Further, while random sized polystyrene pellets may be interspersed within the closed cell foam, it has been found that using polystyrene pellets of uniform size interspersed within the closed cell foam affords improvements in the flexibility of the resulting garment.

Accordingly, it is a primary object of the present invention to provide a novel and improved cold weather garment having good thermal and buoyancy characteristics and a method of forming the garment.

These and further objects and advantages of the present invention will become more apparent upon reference to the following detailed description, claims and appended drawings wherein:

BRIEF DESCRIPTION OF THE DRAWINGS

FIG. 1 is a schematic perspective view of upper and lower portions of a cold weather garment constructed in accordance with the present invention;

FIG. 2 is an enlarged fragmentary cross-sectional view through a portion of the garment illustrating the closed cell materials interspersed in the open cell foam; and FIG. 3 is an enlarged view similar to FIG. 2 illustrating the intermediate insulating foam with convolutions on one surface.

DETAILED DESCRIPTION OF THE DRAWINGS

An exemplary cold weather garment according to the present invention is illustrated in FIG. 1 as including an upper body garment, generally illustrated at 10, and a lower body garment, generally illustrated at 12. It will be appreciated that the present invention is not limited to two-piece garments, but has applicability generally to all types of garments for use in cold weather conditions, such as jackets, pants, coats and the like. The garment of the present invention is designed such that the individual wearing the garment is protected sufficiently against cold weather conditions such that other garments are not necessary, although other types of garments may be worn under the garment of the present invention.

The construction of the garment of the present invention, as best illustrated in FIG. 2, is comprised of three layers of material, an outer or shell fabric layer 16, an inner liner or fabric layer 18 and an intermediate layer of foam 20 disposed between the inner and outer layers 16 and 18, respectively. The outer fabric layer 18 provides for the desired wind resistance and may be formed of any suitable fabric which has low air permeability, for example on the order of about 15 cubic feet per minute per square foot at 0.5 inches head of water and preferably less than 10 $ft^3/min/ft^2$. The fabric must, however, have good moisture vapor permeability. As set forth in the above-referenced co-pending application, such material may comprise a fabric available commercially from Burlington Industries, Inc. under the trademark "Versatech."

The inner liner 16 may likewise be formed of any conventional and suitable fabric. For example, either knit or woven synthetic fabrics may be utilized, provided the moisture vapor transmission characteristics of the fabric are high. A loosely-knit nylon or polyester tricot fabric may be used as the inner fabric.

According to the present invention, the intermediate layer 20 comprises a composite layer formed of an open cell foam 22, together with closed cell material 24 interspersed in and throughout the open cell material. As will be recalled, while a closed cell material may provide buoyancy characteristics, it does not permit moisture vapor transmission through the garment, which is necessary and desirable for comfort during use. Conversely, an open cell material having a high moisture permeability is desirable but does not have sufficient buoyancy characteristics in water to permit its use in a garment of this type. According to the present invention, there is provided an intermediate layer for the garment comprised of an open cell foam with closed cell material interspersed within the open cell foam whereby good thermal buoyancy characteristics may be obtained in a single garment.

Preferably, the open cell material 22 is a polyurethane which is seeded with closed cell pellets 24 of polystyrene. Thus, both moisture vapor transmission and buoyancy characteristics are afforded the garment and this combination of materials affords good thermal protection under cold weather conditions while providing the additional protection of buoyancy should the individual wearing the garment be immersed in water. Thermal protection is additionally afforded when the garment is immersed in the water and may be afforded over a critical period of time necessary to enable the wearer of the garment to get out of the water. Once out of the water, a further feature of the present construction enables the individual to press or squeeze the water from the garment, i.e., remove the water from the open cells of the intermediate layer, whereby the individual's body heat, once the water is removed, will dry the garment.

While a preferred form of the present invention provides an intermediate layer formed of open cell polyurethane foam with closed cell polystyrene pellets uniformly interspersed therein, the closed cell materials, instead of being comprised of polystyrene pellets, may be formed of ground cork, glass spheres, micro-balloons or other fillers having a relatively low specific gravity.

It will be appreciated that the addition of closed cellular material to the intermediate layer may decrease the flexibility of the garment. To compensate for this, if necessary, the material of the intermediate layer may be convoluted. That is, and as illustrated in FIG. 3, at least one of the surfaces of the intermediate layer 20 may be provided with a series of peaks and valleys 26. By convoluting the surface, the garment is provided with increased flexibility. In another form of the present invention, increased flexibility may be provided the garment by crushing the intermediate layer. To accomplish that, the layer may be placed under pressure, for example, under a roller exerting a pre-determined pressure, i.e., 30 pounds, on the layer. This crushing action improves the flexibility of the intermediate layer and, hence, that of the garment. It also desirably reduces the thickness of the garment and increases its air permeability. Additionally, increased flexibility is provided by providing the intermediate layer with closed cell material of substantially uniform size substantially uniformly dispersed within the closed cell material. Thus, in the preferred embodiment, polystyrene pellets of substantially the same size are uniformly interspersed in the open cell polyurethane intermediate layer.

An additional advantage of the present invention resides in the ease of manufacture of the intermediate layer. Thus, the intermediate layer is formed by seeding the polyurethane foam matrix during the foam manufacture. It will also be appreciated that such ease of manufacture also facilitates the addition of other materials to the foam. For example, coated (aluminized) styrene pellets or bits of aluminized pieces may be added to the foam to alter the infrared radiant characteristics of the foam. Flame retardant or other flame extinguishing media in pellet form could also be inserted. Carbon pellets may be inserted for odor and static control.

In a preferred embodiment of the present invention, a polyurethane foam is seeded with polystyrene pellets such that the pellets comprise 14% wt/vol of the intermediate layer. That construction affords a buoyancy of about 30 lbs/ft$^3$, an air permeability of about 8 ft$^3$/min and a moisture vapor transmission rate of 424 g/m-24 hours. Also, without crushing the foam, it may have a thickness on the order of about 1.1 to 1.2 inches, preferably at least ½ inch thick, affording a weight of about 23 ounces per yard.

It will thus be seen that according to the present invention, a garment is provided for use particularly under cold weather conditions where improved thermal and buoyancy characteristics are desirable. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent garments and methods of making the garments.

We claim:

1. A cold weather garment comprising:

an outer shell;

an inner liner;

an insulating foam intermediate said outer shell and said inner liner; and means for connecting together at least said outer shell and said inner fabric to form a garment;

said intermediate insulating foam comprised of a composite comprising a major portion of an open cell foam, and a minor portion of closed cell material interspersed in the open cell foam, wherein said composite material affords said garment desirable water vapor permeability and buoyancy characteristics.

2. A garment according to claim 1 wherein said closed cell material is comprised of a plastic foam.

3. A garment according to claim 2 wherein said closed cell material comprises polystyrene beads.

4. A garment according to claim 2 wherein said closed cell material comprises micro-balloons.

5. A garment according to claim 1 wherein said closed cell material comprises ground cork.

6. A garment according to claim 1 wherein said closed cell material comprises glass spheres.

7. A garment according to claim 1, wherein said insulating foam comprises polyurethane and said closed cell material comprises polystyrene pellets.

8. A garment according to claim 7 wherein said polystyrene pellets are substantially uniform in size throughout said polyurethane foam.

9. A garment according to claim 8 wherein at least one surface of said intermediate insulating foam is convoluted.

10. A garment according to claim 1 wherein at least one surface of said intermediate insulating foam is convoluted.

11. A garment according to claim 1 wherein said intermediate insulating foam is crushed.

12. A cold weather garment comprising:

an outer shell;

an inner liner;

an insulating foam intermediate said outer shell and said inner liner;

means for connecting together at least said outer shell and said inner liner to form a garment;

said intermediate insulating foam consisting of a composite comprising a major portion of an open cell foam, and a minor portion of polystyrene pellets of substantially uniform size interspersed in said open cell foam, wherein said composite affords said garment desirable water vapor permeability and buoyancy characteristics.

13. A garment according to claim 12 wherein the intermediate foam is at least ½ inch thick.

14. A garment according to claim 1 wherein the intermediate foam is at least ½ inch thick.

15. A method of manufacturing a cold weather garment comprising:

(a) providing inner and outer liners for the garment;

(b) forming an intermediate insulating foam comprised of a major portion of an open cell foam with a minor portion of a closed cell material interspersed in the open cell foam;

(c) disposing said insulating foam intermediate said inner and outer liners; and (d) operatively connecting said inner and outer liners one to the other with said intermediate insulating foam disposed therebetween to form said garment.

16. A method according to claim 15 wherein the step of forming an insulating foam includes interspersing polystyrene beads in said open cell foam.

17. A method according to claim 15 including the step of increasing the flexibility of said garment by convoluting the insulating foam.

18. A method according to claim 15 wherein, prior to step (c), there is included the step of crushing said intermediate insulating foam, thereby accomplishing at least one of increasing the garment's flexibility, reducing its thickness, and increasing its air permeability.

19. A method according to claim 15 wherein the step of forming includes the step of interspersing polystyrene beads of substantially uniform size in and throughout said open cell foam.

20. A method according to claim 15 wherein step (b) is practiced by interspersing in the open cell foam a material selected from the group consisting of closed cell foam beads, glass spheres, ground cork, and microballoons.

* * * * *